United States Patent [19]

Sakaguchi

[11] Patent Number: 4,585,725

[45] Date of Patent: Apr. 29, 1986

[54] PHOTOGRAPHIC IMAGE-RECEIVING ELEMENT FOR SILVER SALT DIFFUSION TRANSFER PROCESS

[75] Inventor: Shinji Sakaguchi, Kanagawa, Japan

[73] Assignee: Fuji Photo Film Co., Ltd., Kanagawa, Japan

[21] Appl. No.: 641,102

[22] Filed: Aug. 15, 1984

[30] Foreign Application Priority Data

Aug. 15, 1983 [JP] Japan ..... 58-148979

[51] Int. Cl.[4] ..... G03C 5/54

[52] U.S. Cl. ..... 430/232; 430/233

[58] Field of Search ..... 430/231, 232, 233

[56] References Cited

U.S. PATENT DOCUMENTS

| | | | |
|---|---|---|---|
| 3,607,269 | 9/1971 | Young | 430/232 |
| 3,671,241 | 6/1972 | Land | 430/231 |
| 3,873,317 | 3/1975 | Kato et al. | 430/232 |
| 3,969,541 | 7/1976 | Mukaida et al. | 430/232 |
| 4,520,096 | 5/1985 | Endo et al. | 430/233 |

*Primary Examiner*—Richard L. Schilling

*Attorney, Agent, or Firm*—Sughrue, Mion, Zinn, Macpeak and Seas

[57] ABSTRACT

An image-receiving element for a silver salt diffusion transfer process is described, having an excellent storability before and after development; said element has at least one hydrophilic polymer layer between a layer of a first hydrolyzable alkali-impermeable polymer and an alkali-permeable image-receiving layer which is obtained by hydrolysis at least a part of a layer of the second alkali-impermeable polymer, and which contains silver depositing nuclei, said first layer contains at least one diffusible organic solvent-soluble compound for modifying the photographic properties of a silver transfer image to be formed in the alkali-permeable polymer layer by photographic processing.

31 Claims, No Drawings

PHOTOGRAPHIC IMAGE-RECEIVING ELEMENT FOR SILVER SALT DIFFUSION TRANSFER PROCESS

FIELD OF THE INVENTION

This invention relates to an image-receiving element for diffusion transfer photographic processes and more particularly to an image-receiving element wherein silver depositing nuclei are finely dispersed in a matrix material which is permeable to an alkaline processing composition. Furthermore, the invention relates to an image-receiving element for diffusion transfer photographic process having improved shelf life.

BACKGROUND OF THE INVENTION

Hitherto, a diffusion transfer photographic process utilizing a silver salt such as silver halide is well known in the art. In such a photographic process, a photographic material prepared by coating a film of a polymeric material such as polyethylene terephthalate, cellulose diacetate, cellulose triacetate, cellulose nitrate, polycarbonate, polyvinyl chloride, etc., or a paper or a baryta-coated paper with a dispersion of fine grains of a photosensitive silver salt such as a silver halide in a hydrophilic binder such as gelatin, polyvinyl alcohol, carboxymethyl cellulose, polyvinylpyrrolidone, methyl cellulose, etc., is imagewise exposed as a function of incoming electromagnetic rays and developed by contacting with a developer containing a developing agent. In this case, the light-exposed silver halide in the photosensitive layer is reduced to form non-diffusible silver. When the photosensitive layer is brought into contact with a water-soluble silver complex salt-forming agent simultaneously with or after the above-described development, the unexposed silver halide reacts with the aforesaid water-soluble silver complex salt-forming agent to form a water-soluble silver complex salt. In this case, when an image-receiving element having a layer (image-receiving layer) containing therein a material (i.e., silver depositing nuclei, so-called physical development nuclei or centers), which becomes a catalyst for the reduction reaction of the above-described water-soluble silver complex salt dispersed in a hydrophilic binder is closely brought into contact with the above-described photosensitive layer, the silver complex salt formed in the photosensitive layer diffuses from the photosensitive layer into the image-receiving layer by the existence of a processing liquid, and is reduced to silver by the action of the development nuclei in the image-receiving layer. That is, a silver image is formed in the image-receiving layer as if an image was transferred from the photosensitive layer into the image-receiving layer. From such a technical viewpoint, the above-described photographic process is called a "silver salt diffusion transfer photographic process".

Image-receiving elements for diffusion transfer photographic processes containing a silver depositing agent in an alkaline processing composition-permeable matrix material are known, as described, for example, in U.K. Pat. No. 1,149,921.

In the field of silver salt diffusion transfer photography, the image-receiving element for the photographic process has hitherto been extensively investigated. For example, as the silver depositing nuclei, sparingly water-soluble metal sulfides, metal selenides, heavy metal or noble metal colloids are usually used, and it is preferred that the silver depositing nuclei for the image-receiving element be highly active. For example, U.S. Pat. No. 2,698,237 describes a process of obtaining silver depositing nuclei having a high activity by mixing a water-soluble metal salt and a water-soluble sulfide in a colloidal silica to form a precipitations of water-insoluble metal sulfide. Also, Japanese Patent Publication No. 32754/69 describes an image-receiving element prepared by incorporating a silver depositing nucleus material in an alkali-impermeable polymer material by a vacuum vapor deposition method, dissolving the polymer material in a solvent for the polymer material coating the polymer solution on a support followed by drying, and rendering the surface layer of the polymer layer alkali permeable by a chemical treatment such as hydrolysis, etc.

Also, Japanese Patent Application (OPI) No. 73150/73 (the term "OPI" as used herein refers to a published unexamined Japanese patent application) describes an image-receiving element for the silver halide diffusion transfer process, prepared by hydrolyzing a cellulose ester layer and incorporating silver depositing nuclei in the hydrolyzed layer simultaneously with or after the hydrolysis. However, the image-receiving element prepared in the aforesaid manner has a disadvantage in that the silver image formed in the image-receiving element is liable to discolor or fade during storage of the image-receiving element.

As a method for overcoming the disadvantage, a method has been proposed of coating a water-soluble polymer liquid containing an alkali neutralizing component on the surface of the silver image thus formed, as described in Japanese Patent Publication No. 5392/71, U.S. Pat. No. 3,533,789, and U.K. Pat. No. 1,164,642. However, this method encounters a disadvantage in that it requires a considerable time to completely dry the surface coated with the aqueous polymer solution, and hence the surface is sticky for a long period of time, during which a print cannot be placed on the surface, and a fingerprints or dust may frequently stick to the surface. Furthermore, the coating operation of such an aqueous solution on the surface of silver image is troublesome.

In U.S. Pat. No. 3,607,269, corresponding to Japanese Patent Publication No. 44418/81, an image-receiving material for the silver salt diffusion transfer process is disclosed, which comprises a support having formed thereon (I) a layer of a cellulose ester, a polyvinyl ester, or a polyvinyl acetal, which is hydrolyzable and becomes alkali soluble when it is hydrolyzed, containing a diffusible compound suitable for modifying the photographic properties of transferred silver images, and (II) a reproduced cellulose layer containing silver depositing nuclei, said layer (I) containing no silver depositing nuclei and said layer (II) containing no aforesaid diffusible compound. Also, as the aforesaid diffusible compound, an organic mercapto compound is described.

Further, according to the above-noted U.S. Pat. No. 3,607,269, it is described that the diffusible compound is dispersed in the layer under the image-forming layer prior to the diffusion transfer processing, and a toning agent and a stabilizer are released from the lower layer during diffusion transfer processing, whereby the effect of the diffusible compound during the diffusion transfer process is increased.

Also, it is clearly described in the aforesaid U.S. Pat. No. 3,607,269 that layer (I) and layer (II) are not independent or separate layers, but rather a single continuous layer having partially different properties in the depth direction. When these layers are formed as plural continuous coatings, they are coated using a common solvent, and they are formed into a single layer without forming any interface; it is considered that this feature is an essential characteristic for obtaining the above-described effect. According to the above-described technique, at least a toning agent is present in the layer (I) at the first stage of development, and it diffuses into the layer (II) with the progress of development to act therein as toning agent. As well known to those in the art, a toning agent has an action of changing the color of images by acting at the step of forming developed silver and giving influences on the surface form and other optical properties of the developed silver thus formed; hence, the effect is not obtained if the toning agent does not diffuse into the upper layer from the lower layer.

However, the technique described in U.S. Pat. No. 3,607,269 is very conceptional, and involves many difficult problems in practical use. Hence, it is difficult to use from a practical viewpoint, as is clear to researchers engaging in this art.

That is, first, even when the diffusible compound is incorporated in the layer (I) only in the step of forming the image-receiving material, the mercapto-substituted compound such as 1-phenyl-5-mercaptotetrazole, imidazolidinethion, etc., which is illustrated as the diffusible compound in the patent, is very soluble in the organic solvent which is used for coating, the layer (I) is swelled by the coating solvent for the layer (II) when coating the layer (II) on the layer (I), whereby the diffusible compound diffuses into the layer (II) and is almost uniformly re-distributed in the layer (I) and layer (II). Second, the diffusible compound thus diffused into the layer (II) can be removed by dissolving off with a hydrolysis solution by applying thereto a hydrolysis treatment, but even when such a treatment is applied, the diffusible compound diffuses into the layer (II) from the layer (I) during the period prior to the image-receiving material being practically used by users after production thereof. This adversely affects the photographic characteristic, and if the amount of the diffusible compound contained in the layer (I) is reduced in order to reduce these disadvantages, a sufficient modification of photographic properties of the transferred images cannot be obtained. The above-mentioned difficult problems occur because the layer (I) and layer (II) are composed of very similar components, such that an interface is not formed between the layers, whereby materials in each layer easily diffuse into both layers.

SUMMARY OF THE INVENTION

An object of the present invention is to provide a photographic image receiving element for a silver salt diffusion transfer process which is free from deterioration of photographic characteristics during storage thereof prior to use, and free from deterioration of silver images formed in the receiving layer during storage thereof after development.

As the results of various investigations for solving the above-described problems, the inventors have discovered that the above-described disadvantages in the conventional techniques can be substantially eliminated by an image-receiving element for a silver salt diffusion transfer process having at least one layer of a hydrophilic polymer between a layer of a first hydrolyzable alkali-impermeable polymer layer and an alkali-permeable image-receiving layer which is obtained by hydrolysis at least a part of a layer of the second alkali-impermeable polymer and which contains silver depositing nuclei, said first layer containing at least one diffusible organic solvent-soluble compound for modifying the photographic properties of a silver transfer image to be formed in the alkali-permeable polymer layer by photographic processing.

DESCRIPTION OF THE PREFERRED EMBODIMENT

As the hydrophilic polymer which is used between the first alkali-impermeable polymer layer and the second alkali-impermeable polymer layer, in this invention, water-soluble polymers or water-swelling polymers are suitable.

Examples of the hydrophilic polymers include natural polysaccharides and the derivatives thereof, natural proteins and the derivatives thereof, synthetic hydrophilic polymers, etc.

More practically, natural saccharides and the derivatives thereof include, for example, guar gum, locust bean gum, carrageenan, pectin, algins (e.g., alginic acid, sodium alginate, etc.), cellulose derivatives [e.g., carboxymethyl cellulose, cellulose sulfate (sodium salt, potassium salt, quaternary ammonium salt, etc.), methyl cellulose, hydroxyethyl cellulose, hydroxypropyl cellulose, hydroxypropyl cellulose acetate phthalate, hydroxyethylcarboxymethyl cellulose, etc.], starch and the derivatives thereof (e.g., starch, $\alpha$-starch, carboxymethyl starch, hydroxypropyl starch, dialdehydostarch, etc.), dextran, dextran sodium sulfate, pullulane, xanthan gum mannan, karaya gum, gum ghatti, gum tragacanth, etc.

Natural proteins and the derivatives thereof include, for example, gelatin, phthalated gelatin, gluten, casein, albumin, glue, etc.

Synthetic hydrophilic polymers include, for example, polyvinyl alcohol, polyvinyl methyl ether, polyvinylpyrrolidone, polyvinylacetamide, salts of polyvinyl sulfonic acid and polyacrylic acid (sodium salt, potassium salt, quaternary ammonium salt, etc.), polyacrylamide, poly-N-methylacrylamide, poly-hydroxyalkyl-(meth)acrylate (e.g., poly-2-hydroxyethyl acrylate, poly-2-hydroxyethyl methacrylate, etc.), sodium polyglutamate, sodium polystyrenesulfonate, polyvinylbenzyl-trimethylammonium chloride, etc., and copolymers of monomers which compose these polymers (e.g., an acrylamide-sodium acrylate copolymer, an acrylamide-N,N-dimethylacrylamide copolymer, an acrylamide-N-methoxymethylacrylamide copolymer, an acrylamide-2-hydroxyethyl methacrylate copolymer, a 2-hydroxyethyl acrylate-2-hydroxyethyl methacrylate copolymer, a methyl vinyl ether-sodium maleate copolymer, a styrene-sodium maleate copolymer, a styrene-sodium maleamate copolymer, a vinyl acetate-vinyl alcohol copolymer, a vinyl acetate-sodium maleate copolymer, a vinylpyrrolidone-acrylamide copolymer, etc.).

These materials may be used solely or as a mixture thereof. Among these materials, natural saccharides and the derivatives thereof and the synthetic hydrophilic polymers as described above are preferred from the point of the status of the coated surface, coating properties, solubility and adhesion between the first alkali-impermeable polymer layer and the second alkali-impermeable polymer layer. Among them, dextran and the derivatives thereof, agarose, starch, alginates, acrylamide polymers (homopolymers and copolymers), etc., are more preferred, and furthermore, starch and acrylamide polymers (homopolymers and copolymers) are particularly excellent from the viewpoint of the hardening property for securing water resistance and high adhesive property of the polymer layer.

It is preferred that the hydrophilic polymer layer in this invention be hardened for securing the step of producing the photographic image-receiving element and for securing the water resistance of the image-receiving element and the adhesive property of the polymer layer with adjacent layers.

Hardening agents which are used for the purpose are well known in the art as described, for example, in *Product Licensing Index,* Vol. 92, page 108, Paragraph entitled "Hardeners".

Among these hardeners, aldehyde series hardeners (e.g., formalin, glyoxal, glutaraldehyde, dialdehyde starch, etc.) and N-methylol (or alkoxymethyl) series hardeners (e.g., dimethylolurea, trimethylolmelamine, hexamethylolmelamine, hexamthoxymethylmelamine, poly-N-methylolacrylamide, poly-N-methoxymethylacrylamide, etc.) are preferably used.

The water-soluble hydrophilic polymer which is used in this invention is preferably that which has a solubility of more than 1%.

Furthermore, the hydrophilic polymer which is used in this invention is alkali permeable and it is particularly preferred that the permeability has a proper resistance to an alkaline aqueous solution. That is, since the organic solvent-soluble compound, for example, a compound having the properties of increasing the preservative stability of a silver image formed by performing an image-forming process by spreading a photographic processing composition between the image-receiving element of this invention and an image-exposed light-sensitive material but causing a development hindrance if the compound exists upon the formation of silver image exists in the first hydrolyzable alkali-impermeable polymer, if the hydrophilic polymer layer has a high alkali permeability, a part of the first alkali-impermeable polymer layer is hydrolyzed by an alkali permeated through the hydrophilic polymer layer before finishing the formation of silver image and the compound contained in the first layer becomes diffusible by the alkali substance, whereby the compound diffuses into the second layer to give undesirable influences on the formation of silver image. Accordingly, by using a hydrophilic polymer layer having retardative property for the permeation of alkali, a compound having a property of increasing the preservative property for silver image together with the property of hindering the development, the use of such compound has hitherto been difficult, can be advantageously used. The hydrophilic polymer layer having a proper resistance to an alkaline aqueous solution can be obtained by selecting the thickness of the layer depending on the kind of the polymer.

As the solvent used at coating the hydrophilic polymer layer in this invention, water is generally used, but if desired, a mixture of water and a water-soluble organic solvent such as an alcohol (methanol, ethanol, propanol, ethylene glycol, etc.), acetone, acetonitrile, dioxane, formamide, tetrahydrofuran, etc., may be used. The amount of the water-soluble organic solvent should not exceed to such an extent that the organic solvent-soluble compound is dissolved into the mixture.

For coating the hydrophilic polymer layer in this invention, it is preferred to use a coating aid. Practical coating aids which are used in this invention are described in *Product Licensing Index,* Vol. 92, page 108, Paragraph entitled "Coating Aids".

Also, the hydrophilic polymer layer in this invention can contain, if desired, various additives such as, for example, preservatives (e.g., glycerol, ethylene glycol, diethylene glycol, triethylene glycol, trimethylolpropane, pentaerythritol, triacetin, etc.), optical whitening agents, antistatic agents, plasticizers, etc. The amount of a preservative in this layer is preferably less than 50 wt%, more preferably less than 30 wt% based on the weight of the polymer.

There is no particular restriction about the thickness of the hydrophilic polymer layer which is used between the first and second alkali-impermeable polymer layers according to this invention, but it is preferred that the thickness of the hydrophilic polymer layer be from about 0.05 to 20 g/m$^2$, and more preferably from about 0.05 to 5 g/m$^2$, from the viewpoints of controlling the diffusion of the compound which contributes to the formation and improvement of the silver transfer image and from the view points of water resistance of the image receiving element.

As the diffusible organic solvent-soluble compound which is used for the layer of the first hydrolyzable alkali-impermeable polymer and which is able to modify the photographic properties of the silver transfer image formed in the second polymer layer, there are, for example, organic mercapto compounds (including tautomers), imino compounds and iodine compounds, and these compounds are particularly effective for improving the preservative stability of the silver image. In particular, it is known that mercapto compounds and imino compounds have an excellent property of protecting silver images from discoloring and fading. In this invention, various known mercapto compounds and imino compounds can be used and there is no particular restriction on the kind of the compounds.

However, it is necessary that the mercapto compound or imino compound used in this invention be of essentially diffusible. This is because the effect of this invention can be attained by that the mercapto compound or imino compound becomes diffusible by the action of the alkali in a developer permeated after development and diffuses into the image-receiving layer to protect the silver image in the layer.

Then, some practical examples of these compounds are illustrated below but the compounds in this invention are not limited to them.

(1) Imidazolidinethions such as unsubstituted and 1-alkyl- or aryl-substituted imidazolidinethion, etc.

(2) Mercaptoimidazoles such as unsubstituted and 1-alkyl- or aryl-substituted 2-mercaptoimidazole, unsubstituted or allyl- or nitro-substituted 2-mercaptobenzimidazole, etc.

(3) Triazoles such as unsubstituted and 4- and/or 5-position substituted 3-mercapto-4H-1,2,4-triazole (examples of the substituent are an alkyl group or an aryl group), unsubstituted and 5-alkyl-nitro- or halogen-substituted benzotriazole, etc.

(4) Tetrazoles such as unsubstituted and 1-alkyl- or aryl-substituted 5-mercapto-1H-tetrazole, etc.

(5) Mercaptopyrimidines such as unsubstituted and 4- and/or 6-position-substituted 2-mercaptopyrimidine (Examples of the substituent are an alkyl group, a hydroxy group or a mercapto group), etc.

(6) Mercaptotetrazapentalenes such as unsubstituted and 3- and/or 6-substituted 1,4-dimercapto-3H,6H-

2,3a,5,6a-tetrazapentalene (examples of the substituent are an alkyl group or an aryl group), etc.

(7) Imidazoles such as unsubstituted or 5-alkyl, nitro-halogen-substituted 1H-imidazole, unsubstituted and 5-alkyl, nitro- or halogen-substituted benzimidazole, etc.

(8) Benzothiazoles such as unsubstituted and α- and-/or 5-substituted benzothiazole (examples of the substituent at the 2-position are an alkyl group or a nitro group), etc.

(9) Cysteine.

(10) Mercatotetraazaindenes such as unsubstituted and 6-alkyl, hydroxy- or mercapto-substituted 4-mercapto-1,3,3a,7-tetraazaindene, etc.

In these compounds, the alkyl group has preferably less than 12 carbon atoms and may be of straight chain or branched. The compound having an alkyl group having 13 or more carbon atoms has low diffusibility. Examples of the aryl group are a phenyl group and a substituted phenyl group such as a tolyl group.

Other various mercapto compounds described in Japanese Patent Publication No. 3835/70 can be also used in this invention.

Typical examples of these compounds are 2-imidazozolidinethion, 1-ethyl-2-imidazolidinethion, 1-(3-methylphenyl)-2-imidazolidinethion, 2-mercaptoimidazole, 3-phenyl-2-mercaptoimidazole, 3-mercapto-4H-1,2,4-triazole, 4-phenyl-3-mercapto-4H-1,2,4-triazole, 5-propyl-2-mercaptobenzimidazole, 5-phenyl-2-mercaptobenzimidazole, 5-nitro-2-mercaptobenzimidazole, 2-mercaptobenzimidazole 1-ethyl-5-mercapto-1H-tetrazole, 1-phenyl-5-mercapto-1H-tetrazole, 5-mercapto-1H-tetrazole, 2-mercaptopyridine, 4-ethyl-2-mercaptopyridine, 4-hydroxy-2-mercaptopyrimidine, 4-hydroxy-2-mercaptopyrimidine, 2,4-dimercaptopyrimidine, 6-methyl-2-mercaptopyrimidine, 6-hydroxy-2-mercaptopyrimidine, 2,6-dimercaptopyrimidine, 4-ethyl-6-ethyl-2-mercaptopyrimidine, 4-methyl-6-hydroxy-2-mercaptopyrimidine, 4-nonyl-2,6-dimercaptopyrimidine, 4-hydroxy-2,6-dimercaptopyrimidine, 4,6-dihydroxy-2-mercaptopyrimidine, 1,4-dimercapto-3H,6H-2,3a,5,6a-tetrazapentalene, 3,6-diphenyl-1,4-dimercapto-3H,6H-2,3a,5,6a-tetrazapentalene, benzotriazole, 6-nitrobenzotriazole, 6-chlorobenzotriazole, 6-bromobenzotriazole, 6-octyl-benzotriazole, 1H-indazole, 5-nitro-1H-indazole, 5-chloro-1H-indazole, 5-bromo-1H-indazole, 5-iodo-1H-indazole, 5-methyl-1H-indazole, benzimdiazole, 5-nitrobenzimdiazole, 5-methylbenzimidazole, zimidazole, 2-mercaptobenzthiazole, 2-mercaptobenzimidazole, cysteine, 4-mercapto-1,3,3a,7-tetraazaindene, 6-methyl-4-mercapto-1,3,3a,7-tetraazaindene, 6-nonyl-4-mercapto-1,3,3a,7-tetraazaindene, 6-lauryl-4-mercapto-1,3,3a,7-tetraazaindene, etc.

As the organic mercapto compounds or imino compounds, mercapto compound precursors or imino compound precursors capable of dissociating or decomposing under an alkaline condition to form corresponding organic mercapto or imino compounds or the metal salts of organic mercapto compounds or imino compounds may also be used.

The mercapto compound precursors include, for example, 2-morpholinomethyl-4-phenyl-1,2,4-triazole-3-thion, 1-morpholinomethyl-4-phenyltetrazole-5-thion, 2-phenyl-4-hydroxymethyl-1,2,4-triazole-3-thion, 2-acetylthioimidazole, 5-ethoxycarbonylthio-3-methyl-4-phenyl-1,2,4-triazole, 5-ethoxycarbonylthio-4-phenyltetrazole, α-thioctic acid, cystine, 3-morpholinomethylbenzothiazoline-2-thion, 5-methyl-3-morpholinomethyloxazolidine-2-thion, 1-morpholinomethyl-4-(4'-methylphenyl)tertazol-2-ine-5-thion, 4-piperidinomethyl-1-phenyltetrazole-2-ine-5-thion, 4-morpholinomethyl-2-phenyl-1,3,4-oxadiazol-2-ine-5-thion, 3-piperidinomethyl-4-thiazolidine-2-thion, 2-amino-4-morpholinomethyl-1,3,4-thiazol-2-ine-5-thion, 4-methyl-3-morpholinomethyl-4-thiazoline-2-thione, etc.

As the metal salts of organic mercapto compounds, there are salts or complex compounds of the aforesaid mercapto compounds and various metal ions such as the ions of gold, lead, platinum, cadmium, zinc, iron, cobalt, sodium, potassium, calcium, lithium, barium, etc.

The amount of the diffusible compound added to the first layer capable of modifying the properties of silver image depends on the kind of the compound used but is usually about $10^{-6}$ to $10^{-2}$ mole/m$^2$, preferably about $10^{-4}$ to $5\times10^{-3}$ mole/m$^2$.

An organic solvent generally well known in the art can be used for preparing coating compositions of the first and the second layers. the organic solvents may be used solely or as a mixture of two or more solvents. Then, examples of the preferred solvents are alcohols such as methanol, ethanol, propanol, ethylene glycol, diethylene glycol, glycerol, etc.; ketones such as acetone, methyl ethyl ketone, cyclohexanone, etc.; esters such as methyl acetate, ethyl acetate, ethyl formate, methyl butyrate, etc.; halogenated hydrocarbons such as methylene chloride, dichloroethane, dichloroethylene, trichloroethane, chloroform, etc.; ethers such as diethyl ether, tetrahydrofuran, dioxane, etc.; amides such as formamide, dimethylformamide, etc.; hydrocarbons such as pentane, hexane, heptane, cyclohexane, etc.; and aromatic hydrocarbons such as benzene, toluene, xylene, chlorobenzene, etc.

As the first and second hydrolyzable alkali-impermeable polymers which are used in this invention, there are, for example, cellulose esters such as cellulose acetate, cellulose diacetate, cellulose propionate, cellulose acetate butyrate, etc.; polyvinyl esters such as polyvinyl acetate, polyvinyl propionate, polyvinyl chloroacetate, etc.

The alkali-impermeable polymer layer composed of at least one of these polymers can be rendered alkali permeable by the hydrolysis with an aqueous alkali solution. Also, polyvinyl acetals such as polyvinyl formal, polyvinyl acetal, polyvinyl butyral, etc., may be used for the second alkali impermeable polymer layer. In this case, the polymer layer can be rendered alkali permeable by an acid hydrolysis.

In the first and second hydrolyzable alkali-impermeable polymer layers which are used in this invention, the second alkali-impermeable polymer layer must be rendered alkali permeable by hydrolyzing at least a part (in the direction of the layer thickness) of the second alkali-impermeable polymer layer before using the second polymer layer as the image-receiving element for silver salt diffusion process. Furthermore, for improving the adhesive property of the hydrophilic polymer layer formed between the first hydrolyzable alkali-impermeable polymer layer and the second hydrolyzable alkali-impermeable polymer layer, a part of the first alkali-impermeable polymer layer may be rendered alkali permeable. The thickness of the layer rendered alkali permeable preferably not more than ½ of the thickness of the second polymer layer, and it may be 1/10 of the thickness.

For rendering the alkali-impermeable polymer layer alkali permeable by alkali hydrolysis, an alkali such as sodium hydroxide, potassium hydroxide, lithium hydroxide, tetraalkyl-ammonium hydroxide, etc., is dissolved in an aqueous solution containing an alcohol such as methanol and ethanol at a concentration of 10 to 90% to provide a saponification solution and the saponification solution is brought into contact with the polymer layer. As the contact method, any known method, such as brush coating, roller coating, air knife coating, spray coating, or immersion in the saponification bath. By the contact with the saponification liquid, at least a part of the polymer layer is saponified.

The saponified layer becomes alkali permeable and hence a processing liquid for diffusion transfer process becomes permeable through the saponified layer. Since the saponified layer becomes an image-receiving layer, the thickness of the image-receiving layer is controlled by the thickness of the second layer to be saponified and the factors such as the concentration of alkali, the concentration of the alcohol, the time for acting the saponification bath with the polymer layer, and the temperature therefor. It is proper that the thickness of the image-receiving layer in the polymer layer is about 0.1 to 10 microns, particularly about 0.5 to 5 microns. If the thickness of the image-receiving layer is too thin, it becomes difficult to obtain a sufficient transfer density, while if the thickness is too thick, a large amount of a processing liquid permeates in the image-receiving layer to give the tendencies of staining the image-receiving sheet by the oxidation of a developing agent and reducing the preservative stability of silver images.

It is preferred that the second alkali-impermeable polymer layer contains a silver depositing nucleus material. The silver depositing nucleus material can be incorporated in the second alkali-impermeable polymer layer before or after rendering the polymer layer alkali permeable or simultaneously with the chemical treatment for rendering the polymer layer alkali permeable. These processes are well known in the art as described in, for example, Japanese Patent Publication Nos. 32754/69 and 49411/76; Japanese Patent Application (OPI) No. 120,634/74; U.S. Pat. No. 3,179,517, etc.

Examples of the silver depositing nucleus material are heavy metals such as zinc, mercury, lead, cadmium, iron, chromium, nickel, tin, cobalt, copper, etc.; noble metals such as palladium, platinum, silver, gold, etc.; or the sulfides, selenides, tellurides, etc., of these metals, which are generally known as silver depositing nuclei. Such a silver depositing nucleus material can be prepared by reducing a corresponding metal ion to form a metal colloid dispersion or by mixing a metal ion solution with a solution of a soluble sulfide, selenide or telluride to form a colloid dispersion of a water-insoluble metal sulfide, metal selenide or metal telluride.

The behavior of the material such as silver depositing nuclei in silver diffusion transfer process is described in, for example, U.S. Pat. No. 2,774,667 issued December 18, 1956. For obtaining an image-receiving element giving an image having preferred tone, the silver depositing nuclei are incorporated in the image-receiving layer in an amount of usually from $10^{-10}$ to $10^{-5}$ g/m$^2$, and preferably from $10^{-8}$ to $10^{-6}$ g/cm$^2$.

In the photographic image-receiving element for silver salt diffusion transfer process of this invention, it is preferred to incorporate, if desired, a toning agent in the image-receiving layer containing the silver depositing nuclei. The toning agent is a compound capable of changing the color tone of a silver transfer image formed after photographic processing.

Examples of the toning agent which is used in this invention are imidazolidine-2-thion, perhydrodiazine-2-thion, benzimidazoles (e.g., benzimidazole, 2-mercaptobenzimidazole, 2-mercapto-5-methylbenzimidazole, 2-mercapto-5-chlorobenzimidazole, etc.), mercaptoimidazoles (e.g., 2-mercaptoimidazole, 2-mercapto-4-phenylimidazole, 1-methyl-2-mercapto-5-phenylimidazole, 1-benzyl-2-mercaptoimidazole, 2-mercapto-1-phenylimidazole, etc.), mercaptotriazoles (e.g., 3-mercapto-4,5-dimethyltriazole, 4-p-toluyl-4H-1,2,4-triazole-3-thiol, etc.), benzotriazoles (e.g., benzotriazole-2-thiol, etc.), tetrazole-5-thiols (e.g., 1-phenyl-5-mercaptotetrazole, 1-ethyl-5-mercapto-1H-tetrazole, etc.), mercaptopyrimidines (e.g., α-mercaptopyrimidine, 2,4-dimercaptopyrimidine, 4-hydroxy-2,6-dimercaptopyrimidine, etc.), tetrazapentalenes (e.g., 1,4-dimercapto-3H,6H-2,3a,5,6a-tetrazapentalene, 3,6-diphenyl-1,4-dimercapto-3H,6H-2,3a,5,6a-tetrazapentalene, etc.), etc.

Moreover, the compounds described in Andre Bott, Dipl. Ing, and Edith Weyde, Dr. Ing., *Photographic Silver Halide Diffusion Processes;* Chapter 3.2.4.4; pages 61–65; U.S. Pat. No. 3,756,825; German Pat. No. 1,903,741; U.K. Pat. No. 1,230,470 and French Pat. No. 2,090,476 can be effectively used as the color toning agent in this invention.

The amount of the toning agent depends upon the kind of the compound to be used but since if the amount is too small, the tone of the silver transfer image formed becomes red-black tone and if the amount is too large, the tone becomes lead gray or the total optical density lowers, the amount is usually about $10^{-9}$ to $10^{-4}$ mole/m$^2$, preferably about $10^{-7}$ to $10^{-5}$ mole/m$^2$.

Among the above-described toning agents, benzimidazoles, mercaptoimidazoles, and mercaptopyrimidines are preferred.

The thicknesses of the first polymer layer and the second polymer layer are usually 0.1 to 20 microns and 0.1 to 10 microns, respectively, preferably 0.5 to 10 microns and 0.5 to 5 microns, respectively. If the thicknesses of the first polymer layer and the second polymer layer are too thin, each layer cannot exhibit the sufficient function. On the other hand, if the thickness of each layer is too thick, a large amount of developer remains in each layer to give stains and reduce the preservative stability of images.

It is preferred that the image-receiving element of this invention be supported by a support. As the support, there are papers; pigment-coated papers such as baryta-coated papers, titanium white-coated papers, etc.; papers coated with a high molecular material such as cellulose acetate, cellulose nitrate, polyvinyl butyral, polyvinyl formal, cellulose butyrate, cellulose acetate butyrate, cellulose propionate, polyethylene, polystyrene, etc., by a lacquer coating method or an emulsion coating method; and films of a high molecular material such as polyethylene terephthalate, cellulose diacetate, cellulose triacetate, nitrocellulose, polycarbonate, polyvinyl chloride, etc. That is, all the supports which are ordinary used in the photographic field can be used in this invention. When a support is used in this invention, the first hydrolyzable alkali-impermeable polymer layer is provided firstly on the support.

Furthermore, if desired, an alkali neutralizing layer may be formed in the image-receiving element of this invention. For the alkali neutralizing layer, the polymer acids described in, for example, Japanese Patent Publication No. 33697/73 are used. It is preferred that the alkali neutralizing layer be formed between the support and the first alkali-impermeable polymer layer of the image-receiving element.

Examples of the preferred polymer acids are maleic anhydride copolymers such as a styrene-maleic anhydride copolymer, a methyl vinyl ether-maleic anhydride copolymer, an ethylene-maleic anhydride copolymer, etc.; and (meth)acrylic acid homopolymers or copolymers such as an acrylic acid-alkyl acrylate copolymer, an acrylic acid-alkyl methacrylate copolymer, a methacrylic acid-alkyl acrylate copolymer, a methacrylic acid-alkyl methacrylate copolymer, etc. A mixture of such polymer and a cellulose compound such as cellulose acetate may also be used.

Moreover, as in conventional receiving elements, a layer composed of an alkali-permeable or alkali-soluble polymer, so-called "peelable layer" may be formed on the surface of the second alkali-impermeable polymer layer in the image-receiving material of this invention.

For a gelatino silver halide light-sensitive element which is used together with the image-receiving element of this invention, a silver chloride emulsion, a silver bromide emulsion, a silver iodide emulsion, a silver chlorobromide emulsion, a silver iodobromide emulsion, and a silver chloroiodobromide emulsion can be used. Among these emulsions, a silver bromide emulsion and a silver iodobromide emulsion are preferred. The mean grain size of the silver halide is usually 0.1 to 10 microns. Also, the silver halide emulsions may contain optical sensitizers, chemical sensitizers, antifoggants, gelatin hardeners, surface active agents, etc., according to the purpose thereof. In some cases, a developing agent for development is previously incorporated in the silver halide light-sensitive element.

It has been found that when a silver halide developing agent of a hydroxylamine is used in combination with the silver image-receiving layer of a regenerated cellulose, the hydroxylamine is particularly useful for forming a silver transfer image which does not need or scarecely needs a post-treatment. A particularly useful silver halide developing agent of hydroxylamine is N-alkyl- and N-alkoxyalkyl-substituted hydroxylamines.

Such hydroxylamines are described in, for example, U.S. Pat. Nos. 2,857,274, 2,857,275, 2,857,276, 3,287,124, 3,287,125, 3,293,034, 3,362,961 and 3,740,221.

A particularly effective and preferred silver halide developing agent of hydroxylamine are shown by the general formula $$R^{1A}-\underset{\underset{OH}{|}}{A}-R^{2A}$$

wherein $R^{1A}$ represents an alkyl group, an alkoxyalkyl group, or an alkoxyalkoxyalkyl group and $R^{2A}$ represents a hydrogen atom, an alkyl group, an alkoxyalkyl group, an alkoxyalkoxyalkyl group or an alkenyl group.

It is preferred that the alkyl group, the alkoxy group and the alkenyl group in the above formula each has 1 to 3 carbon atoms. Practical examples of the particularly useful silver halide developing agent of hydroxylamine are N,N-diethylhydroxylamine, N,N-bis-methoxyethyl-hydroxylamine and N,N-bis-ethoxyethyl-hydroxylamine.

Furthermore, dihydroxybenzene compounds (e.g., hydroquinone, t-butylhydroquinone, methylhydroquinone, etc.), the reductone compounds described in U.S. Pat. Nos. 3,672,896 and 4,128,425; and reductic acid compounds described in U.S. Pat. No. 3,615,440 are useful as the silver halide developing agent.

Also, the aforesaid silver halide developing agent may be used together with an auxiliary developing agent such as a phenidone compound, a p-aminophenol compound and an ascorbic acid.

The silver halide solvent may be a thiosulfate of an alkali metal, such as sodium thiosulfate and potassium thiosulfate and is preferably the cyclic imides such as uracil, urazol, 5-methyl-uracil, etc., as described in U.S. Pat. Nos. 2,857,274, 2,857,275 and 2,857,276.

The processing composition which is used in this invention contains an alkali compound preferably a hydroxide of an alkali metal, such as sodium hydroxide and potassium hydroxide. When the processing composition is applied as a thin layer between the superposed light-sensitive element and the image-receiving element and when it is applied so that these three layers are superposed, it is preferred that the processing composition contains a polymer film-forming agent, or a thickener. Hydroxyethyl cellulose and sodium carboxymethyl cellulose are particularly useful for the purpose and they are incorporated in the processing compositions at an effective concentration for giving a proper viscosity by a known principle in diffusion transfer photographic process. The processing compositions may further contain other assistants known in a silver transfer process, such as antifoggants, toning agents, stabilizers, etc.

As the antifoggants and toning agents, mercapto compounds, imidazole compounds, indazole compounds, triazole compounds, etc., are useful. Examples of the particularly useful compounds are described in U.S. Pat. Nos. 3,565,619, 3,756,825, 3,642,473, U.K. Patent No. 1,122,158, West German Patent Application (OLS) No. 1,804,365, etc.

The incorporation of an oxyethylamino compound such as triethanolamine in the processing composition as a stabilizer is useful for increasing the shelf life of the processing composition as described in Sidney Kasman, U.S. Pat. No. 3,619,185.

The image-receiving element of this invention can be used in various modes.

One of these modes is of a type known as a peel apart type diffusion transfer photographic material. In this mode, an image-receiving sheet and the light-sensitive sheet are separately disposed and in the stage of light exposure, the image-receiving material or sheet is folded or wound into a roll from for not hindering the exposure of the light-sensitive material or sheet. After image-exposure, the light-sensitive material is superposed on the image-receiving material and a developer is spread therebetween to perform processing. After processing for a definite time, the image-receiving material is separated from the light-sensitive material. Thus, a positive image is obtained on the image-receiving material.

On the other hand, in other mode known as an integrated negative and positive type diffusion transfer photographic material, an image-receiving element and a light-sensitive material are previously superposed with each other in a unitary structure to form, in appearance, one sheet. In this case, when the image-receiving element has a light transmittance to an extent of not hindering the exposure of the light-sensitive material and the light-sensitive material is imagewise exposed through the image-receiving element and the image formed (image is formed by spreading a processing liquid containing a light intercepting material between the light-sensitive layer and the image-receiving layer) is observed from the same side as exposure a positive image can be seen. When the cover layer on the light-sensitive material and the support of the image-receiving element have a light transmittance and after image-exposing through the cover layer the image formed in the image-receiving element is observed through the support, a negative image is intercepted by a light-reflecting material layer interposed between the image-receiving element and the light-sensitive material a positive image can be seen. Therefore, in the diffusion transfer photographic material of this type, a positive image can be observed without separating the image-receiving material from the light-sensitive material.

As such an integrated negative and positive type diffusion transfer photographic material, systems having various layer structures are known in addition to the above-described system. This invention has been made for providing an image-receiving element of obtaining silver images having high stability and can be applied to all the image-receiving elements in these systems.

The image-receiving element for silver salt diffusion transfer process of this invention gives the merits that when the image-receiving element is stored for a long period of time before performing image processing, the reduction in optical density of silver images in the case of processing the image-receiving element is very small and also during the storage of the silver images thus obtained, discoloring of the images and reduction in optical density are very reluctant to occur.

Furthermore, it is one of the features of this invention that by employing the hydrophilic polymer layer, various kinds of organic solvent-soluble compounds to be incorporated in the first alkali-impermeable polymer layer can be easily used and also various kinds of silver depositing nuclei to be incorporated in the second alkali-impermeable polymer layer can be easily used.

The present invention is clearly different from the invention of Japanese Patent Publication No. 44418/81 in the following features of this invention.

(1) Intermediate layer composed of the hydrophilic polymer:

The interlayer is formed between the first layer containing an image stabilizer and the second layer containing a silver depositing nucleus and the interlayer is not dissolved in or swelled with an organic solvent used for coating these layers and forms an clear interface between these layers, whereby the unnecessary transfer of the image stabilizer during the production of the image-receiving sheet or until the use thereof by users. Also, the interlayer has a resistance to the permeation of an alkali solution, prevents the hydrolysis at the hydrolysis treatment for the second layer from extending to the first layer, prevents the image stabilizer from diffusing into the second layer during development, and gradually diffuses the image stabilizer into the second layer gradually after finishing the development.

(2) Toning Agent:

A toning agent necessary for most suitably controlling the tone of the developed silver image is previously incorporated in a processing solution or an image-receiving layer containing silver depositing nuclei. Therefore, the effective concentration of the toning agent in the image-receiving layer forming a transferred image is kept constantly during the diffusion transfer processing.

As described above, the image-receiving material of this invention having the new construction gives the following merit:

(1) The image-receiving material containing a larger amount of an image stabilizer is obtained and the image-receiving material can be very stably stored during the production process thereof or until the use thereof as well as the occurrence of discoloring or fading of the images thus obtained can be improved.

(2) Since the toning agent is retained in the layer causing the development during development is always a necessary and sufficient amount and the proportion thereof does not change, whereby the images having always constant quality are obtained.

Then, the invention will be explained by the following examples but the invention is not, as a matter of course, limited to these examples.

In Examples, % shows weight%.

EXAMPLE 1

(Preparation of image-receiving element A)

A 10% acetone solution of cellulose acetate (having a saponification degree of 54%) containing 0.097 of 1-phenyl-2-mercaptoimidazole was coated on the surface of a baryta-coated paper (120 g/m$^2$, thickness of 0.140 mm) at a dry coverage of 5 g/m$^2$. On the coated layer was coated a 2% aqueous solution of starch containing 5% (based on the starch) of dialdehyde starch at a dry coverage of 1.1 g/m$^2$. Moreover, a 3% acetone solution of cellulose acetate was coated thereon at a dry thickness of 1.1$\mu$. Then, an alkali solution containing nickel sulfide as silver depositing nuclei was coated thereon at a thickness of 25 ml/m$^2$ and washed and dried to provide image-receiving element A. The composition of the above-described alkali solution used above is as follows.

NaOH—20 g
Water—200 ml
Methanol—800 ml
Glycerol—30 g
NiS—0.06 g

The nickel sulfide contained in the aforesaid alkali solution was prepared by reacting a 20% aqueous solution of nickel nitrate and a 20% aqueous solution of sodium sulfide with stirring well. The volume ratio of the former solution to the latter solution was 1/60.

EXAMPLE 2

(Preparation of image-receiving element B)

A mixed solution of 270 ml of acetone and 30 ml of methanol containing 18 g of cellulose acetate (saponification degree of 53%) and 12 g of a methyl vinyl ether-maleic anhydride copolymer was coated on a polyethylene-laminated paper at a thickness of 70 ml/m$^2$. Then, an acetone solution containing 0.7% of cellulose acetate and 0.299% of 3,6-diphenyl-1,4-dimercapto-3H,6H-2,3a,5,6a-tetrapentalene was coated on the coated layer at a dry thickness of 50 mg/(dm)$^2$. Furthermore, a 5% aqueous solution of polyacrylamide containing 1 ml of formalin was coated thereon at a dry thickness of 2 g/m$^2$. Still further, an acetone solution of cellulose acetate was coated thereon at a dry thickness of 0.01 g/dm$^2$. Then, an alkali solution containing nickel sulfide was coated at a thickness of 20 ml/m$^2$ and dried, and further washed and dried as in Example 1. Furthermore, a methanol solution of $1\times10^{-3}$% of 2-mercaptobenzimidazole was coated thereon in an amount of 18 ml/m$^2$ and dried to provide image-receiving element B.

EXAMPLE 3

By following the same procedure as in Example 1 except that agarose was used at a dry thickness of 2 g/m$^2$ in place of starch in Example 1, image-receiving element C was prepared.

EXAMPLE 4

By following the same procedure as Example 2 except that sodium alginate was used at a dry thickness of 0.2 g/m$^2$ in place of polyacrylamide in Example 2, image-receiving element D was prepared.

EXAMPLE 5

By following the same procedure as in Example 2 except that a polyethylene terephthalate film (of 180$\mu$ in thickness) was used in place of the polyethylene-laminated paper in Example 2, image-receiving element E was prepared.

EXAMPLE 6

(Preparation of image-receiving element F)

A solution of 18 g of cellulose acetate (having a saponification degree of 54%) and 12 g of a styrene-maleic anhydride copolymer (molar ratio 1:1) dissolved in a mixture of 270 ml of acetone and 30 ml of methanol was coated on a polyethylene-laminated paper at a thickness of 54 ml/m$^2$ and dried. Then, an acetone solution containing 7% of cellulose acetate and 0.598% of 3,6-diphenyl-1,4-dimercapto-3H,6H-2,3a,5,6a-tetrazapentalene was coated on the layer at a dry thickness of 5 g/m$^2$. Furthermore, a 5% aqueous solution of polyacrylamide was mixed with a 5% aqueous solution of dimethylolurea and acetic acid (50%) at concentrations of 5% and 1.25%, respectively, and the mixture was coated on the aforesaid layer at a thickness of 25 ml/m$^2$. Furthermore, a finely dispersed liquid of palladium sulfide in an acetone/methanol solution of cellulose acetate was coated on the layer. The palladium sulfide dispersion was prepared by adding a methanol solution of $7\times10^{-3}$ mole of sodium sulfide and a methanol solution of $7\times10^{-3}$ mole of palladium chloride to a 5.3% acetone/methanol (volume ratio 1:9) mixed solution of cellulose acetate with stirring well. The coating liquid contained 1-phenyl-5-mercaptoimidazole at a coverage of $1.25\times10^{-6}$ mole/m$^2$. The dry thickness was 0.8$\mu$. The following alkali liquid was coated on the coated layer at a coverage of 18 ml/m$^2$ was washed and dried to provide image-receiving element F.

Alkaline Liquid

NaOH (purity: 86%)—44.3 g
$H_2O$—200 ml
$CH_3OH$—800 ml

Preparation of comparison image-receiving element I

By following the same procedure as in Example 1 except that coating of the aqueous starch solution was omitted, comparison image-receiving element I was prepared.

Preparation of comparison image-receiving element II

By following the same procedure as in Example 2 except that coating of the aqueous solution of polyacrylamide was omitted, comparison image-receiving element II was prepared.

Preparation of comparison image-receiving element III

By following the same procedures as in Example 6 except that coating of an aqueous solution of polyacrylamide in Example 6 was omitted, comparison image-receiving element III was prepared.

EXAMPLE 7

(Preparation of image-receiving element G)

By following the same procedure as in Example 6 except that a 5% aqueous solution of an acrylamide-N,N-dimethylacrylamide copolymer (molar ratio of 9:1) was used in place of the 5% aqueous solution of polyacrylamide in Example 6 and phosphoric acid (20%) was used in place of acetic acid (50%), image-receiving element G was prepared.

EXAMPLE 8

(Preparation of image-receiving element H)

By following the same procedure as in Example 7 except that an acrylamide-acrylic acid copolymer (molar ratio of 95:5) was used in place of the acrylamide-N,N-dimethylacrylamide copolymer in Example 7, image-receiving element H was prepared.

EXAMPLE 9

(Preparation of image-receiving element J)

By following the same procedure as in Example 7 except that an acrylamide-N-methoxymethylacrylamide copolymer (molar ratio of 93:7) was used in place of the acrylamide-N,N-dimethylacrylamide copolymer in Example 7, image-receiving element J was prepared.

Preparation of comparison image-receiving element IV

By following the same procedure as in Example 5 except that coating of the aqueous solution of polyacrylamide in Example 5 was omitted, comparison image-receiving element IV was prepared.

EXAMPLE 10

By performing a diffusion transfer development process using each of image-receiving elements A to J and comprison image-receiving elements I to IV, the following light-sensitive layer sheet, and the following processing liquid, positive images were obtained.

(1) Preparation of light-sensitive layer sheet:

An emulsion containing silver iodobromide having a mean grain size of 1.0$\mu$ was prepared by an ordinary manner. Then, 100 g of the silver halide was place in a pot and dissolved in a bath maintained at a constant temperature of 50° C. and 10 ml of a 1% aqueous solution of 3-{5-chloro-2-[2-ethyl-3-(3-ethyl-2-benzothiazolinilidene)propenyl]-3-benzoxazolio}propane sulfonate, 4-{2-[3-ethylbenzothiazolin-2-iridine)-2-methyl-1-propenyl]-3-benzothiazolio}propane sulfonate, and 4-hydroxy-6-methyl-1,3,3a,7-tetraazaindene, 10 ml of a 1% aqueous solution of 2-hydroxy-4,6-dichlorotriazine sodium salt, and further 10 ml of a 1% aqueous solution of sodium dodecylbenzenesulfonate were added to the solution with stirring. The finished emulsion was coated on a polyethylene terephthalate base having a subbing layer containing titanium oxide at a dry thickness of 5 microns and dried to provide a sample. The coated amount of silver was 1.0 g/m$^2$.

(2) Processing composition:

Potassium Hydroxide (40% aqueous soln.)—323 ml
Titanium dioxide—3 g
Hydroxy Ethyl Cellulose—79 g
Zinc Oxide—9.75 g
N,N-Bis-methoxyethylhydroxyamine—75 g
Triethanolamine solution (4.5 parts of triethanolamine to 6.2 parts of water)—17.14 g
Tetrahydropyrimdinethion—0.4 g
2,4-Dimercaptopyrimidine—0.35 g
Uracil—80 g
Water—1193 g The light-sensitive layer sheet was exposed through an optical wedge on a sensitometer having a light source of a color temperature of 5400° K. The exposed light-sensitive layer sheet was superposed on each of the above-described image-receiving layer sheet and the above-described processing composition was spread between them at a thickness of 0.05 mm to perform the transfer development. After 45 seconds under an atmosphere of 25° C. since the spread of the processing composition, both the sheets were separated from each other, whereby a positive image was obtained on the image-receiving layer.

The maximum density of each image was measured by using a TCD automatic recording densitometer made by Fuji Photo Film Co., Ltd.

In this case, with respect to the positive images obtained in image-receiving elements E and IV, the transmission density was measured while about the positive images obtained in other image-receiving elements, the reflection density was measured. The results are shown in the following Table 1.

TABLE 1

| Image-receiving Element | A | B | C | D | F | G | H | J |
|---|---|---|---|---|---|---|---|---|
| Maximum Density | 1.7 | 1.65 | 1.55 | 1.5 | 1.7 | 1.72 | 1.7 | 1.75 |

| Image-receiving Element | I | II | III | E | IV |
|---|---|---|---|---|---|
| Maximum Density | 1.3 | 1.28 | 1.4 | 1.0 | 0.7 |

As is clear from the above results, in the case of using the image-receiving elements of this invention (Elements A to J), the high maximum optical density was obtained as compared with the case of using the comparison image-receiving elements (Elements I to IV).

EXAMPLE 11

By following the same procedure as in Example 10 except that each of image-receiving elements A to J and comparison image-receiving elements I to IV was subjected to a forcible deterioration test for 3 days at a relative humidity of 80% and temperature 50° C. before performing the diffusion transfer processing in Example 10, positive images were obtained in the image-receiving elements. The maximum density of each image was measured as in Example 10 and the results are shown in the following Table 2.

TABLE 2

| Image-receiving Element | A | B | C | D | F | G | H | J |
|---|---|---|---|---|---|---|---|---|
| Maximum | 1.5 | 1.6 | 1.4 | 1.45 | 1.6 | 1.64 | 1.63 | 1.66 |

TABLE 2-continued

| Density | | | | | |
|---|---|---|---|---|---|
| Image-receiving Element | I | II | III | E | IV |
| Maximum Density | 0.9 | 1.1 | 1.0 | 0.8 | 0.5 |

As is clear from the above results, it can be seen that in the case of using the image-receiving elements of this invention (Elements A to J), the maximum density of the positive images after applying the above-described forcible deterioration test is remarkably high as compared to the corresponding comparison image-receiving elements (Elements I to IV).

EXAMPLE 12

Each of the images obtained in the image-receiving elements in Example 10 was subjected to a forcible deterioration test for 3 days at a relative humidity of 70% and a temperature of 60° C. and then the maximum density of the images was measured by the same manner as in Example 10. By comparing the value with the maximum density of each image before the forcible deterioration test obtained in Example 10, the reduction in maximum density by the forcible deterioration test was determined, the results being shown in the following Table 3.

TABLE 3

| Image-receiving Element | A | B | C | D | F | G | H | J |
|---|---|---|---|---|---|---|---|---|
| Maximum Density After the Test | 1.6 | 1.6 | 1.46 | 1.37 | 1.65 | 1.65 | 1.62 | 1.66 |
| Reduction in Density After the Test | 0.1 | 0.05 | 0.09 | 0.13 | 0.05 | 0.07 | 0.08 | 0.09 |

| Image-receiving Element | I | II | III | E | IV |
|---|---|---|---|---|---|
| Maximum Density After the Test | 1.1 | 1.05 | 1.12 | 0.95 | 0.45 |
| Reduction in Density After the Test | 0.2 | 0.23 | 0.28 | 0.05 | 0.25 |

As is clear from the above results, it can be seen that in the image-receiving elements of this invention (Elements A to J), the maximum density after the forcible deterioration test of the images is clearly high than the cases of the comparison image-receiving element (Elements I to IV) and also the reduction in density by the forcible deterioration test is less, which show the stability of the images being high.

EXAMPLE 13

After immersing image-receiving elements A to J in water for 15 seconds, the coated surface of each element was squeezed by means of a rubber roller to test the water resistance and the adhesion. The results show that image-receiving elements A, B, C, E, F, G, H and J of this invention caused no peeling of layer and showed good water resistance and adhesion.

While the invention has been described in detail and with reference to specific embodiments thereof, it will be apparent to one skilled in the art that various changes and modifications can be made therein without departing from the spirit and scope thereof.

What is claimed is:

1. An image-receiving element for a silver salt diffusion transfer process, said element having at least one hydrophilic polymer layer between a layer of a first hydrolyzable alkali-impermeable polymer and an alkali-permeable image-receiving layer which is obtained by hydrolysis of at least a part of the layer of a second alkali-impermeable polymer and which contains silver depositing nuclei, said first layer containing at least one diffusible organic solvent-soluble compound for modifying the photographic properties of a silver transfer image to be formed in the alkali-permeable polymer layer by photographic processing, said organic solvent-soluble compound becoming diffusible by the action of alkali in a developer permeated thereto after development.

2. An image-receiving element for a silver salt diffusion transfer process as in claim 1, wherein said hydrolyzable alkali-impermeable polymer is at least one polymer selected from the group consisting of cellulose esters and polyvinyl esters.

3. An image-receiving element for a silver salt diffusion transfer process as in claim 1, wherein the image-receiving layer is composed of an alkali-permeable polymer layer containing a silver depositing nucleus material formed by hydrolyzing at least a part of the layer of the second hydrolyzable alkali-impermeable polymer with an alkali solution containing the silver depositing nuclei.

4. An image-receiving element for a silver salt diffusion transfer process as in claim 1, wherein the image-receiving layer is prepared by hydrolyzing a part of the layer of the second hydrolyzable alkali-impermeable polymer containing the silver depositing nuclei.

5. An image-receiving element for a silver salt diffusion transfer process as in claim 1, wherein said hydrophilic polymer layer comprises of at least one polymer selected from the group consisting of natural polysaccharides and derivatives thereof, and natural proteins and derivatives thereof.

6. An image-receiving element for a silver salt diffusion transfer process as in claim 1, wherein the polymer of the hydrophilic polymer is a synthetic hydrophilic polymer.

7. An image-receiving element for a silver salt diffusion transfer process as in claim 1, wherein the polymer of the hydrophilic polymer layer is a homopolymer or copolymer of acrylamide.

8. An image-receiving element for a silver salt diffusion transfer process as in claim 1, wherein the organic solvent-soluble compound is at least one compound selected from the group consisting of organic mercapto compounds, metal salts and precursors thereof, imino compounds, metal salts and precursors thereof, and iodine compounds.

9. An image-receiving element for a silver salt diffusion transfer process as in claim 8, wherein the organic mercapto compound is at least one compound selected from the group consisting of mercaptotetrazapentalenes and mercaptoimidazoles.

10. An image-receiving element for a silver salt diffusion transfer process as in claim 1, wherein the silver depositing nuclei comprises a metal compound selected from the group consisting of sulfides, selenides, and tellurides of metals.

11. An image-receiving element for a silver salt diffusion transfer process as in claim 10, wherein said metal is at least one metal selected from the group consisting of Zn, Hg, Pb, Cd, Fe, Cr, Ni, Sn, Co, Cu, Pd, Pt, Ag, and Au.

12. An image-receiving element for a silver salt diffusion transfer process as in claim 1, wherein the silver depositing nuclei is obtained from a colloid of a metal.

13. An image-receiving element for a silver salt diffusion transfer process as in claim 12, wherein said metal is at least one metal selected from the group consisting of Zn, Hg, Pb, Cd, Fe, Cr, Ni, Sn, Co, Cu, Pd, Pt, Ag, and Au.

14. An image-receiving element for a silver salt diffusion transfer process as in claim 1, wherein said element has an alkali neutralizing layer between the layer of the first alkali-impermeable polymer and a support whereon the first alkali-impermeable polymer layer is provided.

15. An image-receiving element for a silver salt diffusion transfer process as in claim 14, wherein said alkali neutralizing layer contains a polymer acid.

16. An image-receiving element for a silver salt diffusion transfer process as in claim 15, wherein said polymer is at least one acid selected from the group consisting of maleic anhydride polymers, acrylic acid polymers, and methacrylic acid polymers.

17. An image-receiving element for a silver salt diffusion transfer process as in claim 1, wherein the image-receiving layer contains a toning agent.

18. An image-receiving element for a silver salt diffusion transfer process as in claim 17, wherein the toning agent is at least one compound selected from the group consisting of benzimidazoles, mercaptoimidazoles, and mercaptopyrimidines.

19. An image-receiving element for a silver salt diffusion transfer process as in claim 1, wherein the hydrophilic polymer layer is hardened.

20. An image-receiving element for a silver salt diffusion transfer process as in claim 1, wherein the hydrophilic polymer layer has a thickness of from 0.05 to 20 $g/m^2$.

21. An image-receiving element for a silver salt diffusion transfer process as in claim 1, wherein the first layer contains said organic solvent soluble compound in an amount of from $10^{-6}$ to $10^{-2}$ $mole/m^2$.

22. An image-receiving element for a silver salt diffusion transfer process as in claim 1, wherein the amount of said silver depositing nuclei is form $10^{-10}$ to $10^{-5}$ $g/cm^2$.

23. An image-receiving element for a silver salt diffusion transfer process as in claim 1, wherein the thickness of the first hydrolyzable alkali-impermeable polymer layer is from 0.1 to 20$\mu$.

24. An image-receiving element for a silver salt diffusion transfer process as in claim 1, wherein the thickness of the second hydrolyzable alkali-impermeable polymer layer is from 0.1 to 10$\mu$.

25. An image-receiving element for a silver salt diffusion transfer process as in claim 1, wherein the image-receiving element is supported by a support.

26. An image-receiving element for a silver salt diffusion transfer process as in claim 1, wherein the hydrophilic polymer is a polymer selected from the group consisting of water-soluble polymers and water-swelling polymers.

27. An image-receiving element for a silver salt diffusion transfer process as in claim 26, wherein said water-soluble polymer has a solubility of more than 1%.

28. An image-receiving element for a silver salt diffusion transfer process as in claim 1, wherein the hydrophilic polymer layer is alkali permeable and restrains the permeation of alkali.

29. An image-receiving element for a silver salt diffusion transfer process as in claim 28, wherein said restraining of the permeation is provided by selecting the thickness of the layer depending on the kind of polymer.

30. An image-receiving element for a silver salt diffusion transfer process as in claim 1, wherein the hydrophilic polymer of the hydrophilic polymer layer is selected from the group consisting of polyvinyl alcohol, polyvinyl methyl ether, polyvinyl pyrrolidone, polyvinyl acetatamide, salts of polyvinyl sulfonic acid and polyacrylic acid, polyacrylamide, poly-N-methylacrylamide, poly-hydroxyalkyl(meth)acrylate, sodium polyglutamate, sodium polystyrene sulfonate, polyvinylbenzyltrimethylammonium chloride and copolymers of monomers which comprise the preceding polymers.

31. An image-receiving element for a silver salt diffusion transfer process as claimed in claim 30, wherein the hydrophilic polymer is selected from the group consisting of an acrylamide-N,N-dimethylacrylamide copolymer, an acrylamide-N-methoxymethylacrylamide copolymer, a methyl vinyl ether-sodium maleate copolymer, a styrene-sodium maleate copolymer, a styrene-sodium maleamate copolymer, and a vinyl acetate-sodium maleate copolymer.

* * * * *